United States Patent [19]

Goldsmith

[11] 4,451,177

[45] May 29, 1984

[54] GUIDELINE SYSTEM FOR POSITIONING SUBSEA EQUIPMENT

[75] Inventor: Riley G. Goldsmith, Houston, Tex.

[73] Assignee: Conoco Inc., Ponca City, Okla.

[21] Appl. No.: 346,854

[22] Filed: Feb. 8, 1982

[51] Int. Cl.[3] ..... E02B 17/00; B63B 35/44

[52] U.S. Cl. ..... 405/195; 166/341; 405/224; 405/169

[58] Field of Search ..... 405/169, 195, 203, 224; 166/341, 342, 343, 367

[56] References Cited

U.S. PATENT DOCUMENTS

| | | | |
|---|---|---|---|
| 3,021,909 | 2/1962 | Postlewaite . | |
| 3,032,125 | 5/1962 | Hiser et al. . | |
| 3,215,202 | 11/1965 | Pollard et al. . | |
| 3,458,853 | 7/1969 | Daniels et al. . | |
| 3,943,725 | 3/1976 | Pennock | 166/341 X |
| 4,181,453 | 1/1980 | Vache . | |
| 4,192,383 | 3/1980 | Kirkland et al. . | |
| 4,226,555 | 10/1980 | Bourne, Jr. et al. . | |
| 4,260,291 | 4/1981 | Young et al. . | |
| 4,273,471 | 6/1981 | Burke . | |

OTHER PUBLICATIONS

NL Shaffer Company brochure "1978–1979 Composite Catalog of Oil Field Equipment & Services", pp. 4950–4954.

Vetco Company brochure "1978–1979 Composite Catalog of Oil Field Equipment & Services", pp. 6861–6862.

NL Shaffer Company brochure "1978–1979 Composite Catalog of Oil Field Equipment & Services," pp. 4945–4949.

Vetco Company brochure "1978–1979 Composite Catalog of Oil Field Equipment & Services," pp. 6858–6860.

*Primary Examiner*—David H. Corbin

*Attorney, Agent, or Firm*—A. Joe Reinert

[57] ABSTRACT

A guideline system for positioning subsea equipment utilizes splayed guidelines for exerting lateral forces on the subsea equipment as it is lowered into place.

26 Claims, 6 Drawing Figures

GUIDELINE SYSTEM FOR POSITIONING SUBSEA EQUIPMENT

BACKGROUND OF THE INVENTION

This invention relates generally to a splayed guideline system for positioning subsea equipment as the equipment is lowered from a surface platform to a structure located therebelow in a body of water.

DESCRIPTION OF THE PRIOR ART

When lowering subsea equipment from a surface platform to a structure located therebelow in a body of water, it is necessary to provide a means for laterally positioning the subsea equipment as it is lowered. This problem is particularly acute when positioning equipment from a tension leg platform or other types of platforms which are not themselves maneuverable to aid in the positioning of the subsea equipment being lowered.

The prior art has generally included two types of systems for achieving such lateral positioning.

One system utilizes a plurality of tensioned parallel guidelines connected between the surface structure and a structure located therebelow. Examples of such parallel guidelines are shown in U.S. Pat. No. 4,226,555 to Bourne et al., U.S. Pat. No. 4,192,383 to Kirkland et al., U.S. Pat. No. 4,273,471 to Burke and U.S. Pat. No. 3,032,125 to Hiser et al. Parallel wire guidelines permit a relatively large lateral displacement of the subsea equipment being lowered, when currents or other hydrodynamic forces are moderately large. If there is no other adjacent equipment to interfere with the equipment being lowered, this causes no problem. However, in situations where there is other adjacent equipment, such as for example when multiple risers are being connected between a tension leg platform and a subsea well template, this lateral movement of the subsea equipment being lowered cannot be tolerated because of problems caused when the equipment being lowered engages existing adjacent equipment. Thus, these relatively large lateral displacements commonly experienced with ordinary parallel guideline systems make such prior art systems inadequate for positioning multiple subsea risers and/or other subsea equipment adjacent to one or more existing risers because collisions could damage the adjacent equipment.

The second type of prior art system utilizes thruster jets to maneuver the subsea equipment being lowered. Those systems, however, generally do not provide sufficient force to position large subsea equipment. An example of such a system is shown in U.S. Pat. No. 3,215,202 to Pollard et al.

Another reference showing a somewhat different type of cable system for lowering subsea equipment is U.S. Pat. No. 3,021,909 to Postlewaite.

The tensioning of guide cables with rotary winches is illustrated for example in U.S. Pat. No. 3,032,125 to Hiser et al. It is also known to tension such guidelines with hydraulic ram type tensioners. Typical hydraulic ram type guideline tensioners may be obtained from the NL Shaffer company and from the Vetco company as illustrated at pages 4950–4954 and pages 6961–6862, respectively, of the 1978–79 COMPOSITE CATALOG OF OIL FIELD EQUIPMENT & SERVICES.

It is also known in the prior art to utilize position indicating devices such as cameras or ultrasonic transducers to give an indication at the surface of a position of the equipment as it is being lowered. An example of such position indicating equipment is shown in U.S. Pat. No. 3,215,202 to Pollard et al. which shows the use of television cameras. An ultrasonic type of positioning system is shown in U.S. Pat. No. 3,458,853 to Daniels et al.

Additionally, it is known to utilize a system of spread anchors with a plurality of anchor lines extending laterally and upwardly from the anchors to a device such as a platform which is being slowly submerged into a body of water, and to utilize winches or the like on the anchor lines to position the device being submerged relative to the various anchors. Such systems are shown in U.S. Pat. No. 4,181,453 to Vache and U.S. Pat. No. 4,260,291 to Young et al.

SUMMARY OF THE INVENTION

The present invention provides a system and methods for laterally positioning subsea equipment such as a production riser while lowering said subsea equipment from a surface structure such as a tension leg platform toward a floor of a body of water. This system includes follower means attached to the subsea equipment, and includes at least two and preferably at least three guidelines connected between the surface structure and a fixed structure, such as a subsea wellhead template, located within the body of water below the surface structure, with the guidelines being slidably received by the follower means and arranged so that the guidelines are outwardly splayed in at least one direction above or below the follower means. Preferably the guidelines are splayed in both directions above and below the follower means. Tension means is provided for tensioning the splayed guidelines to exert a lateral force on the subsea equipment. This tension means may provide either a constant tension or an individually variable tension on the three guidelines depending on the particular application. Additionally, constantly tensioned parallel guidelines may be utilized to assist in the guidance of the subsea equipment as it is being lowered.

It is therefore a general object of the present invention to provide an improved guidance system for lowering subsea equipment into position beneath the ocean surface.

Another object of the present invention is the provision of a system for laterally positioning subsea equipment by utilizing at least two and preferably at least three guidelines slidably engaged with the subsea equipment and arranged so that the guidelines are outwardly splayed in at least one direction above or below the subsea equipment.

And another object of the present invention is the provision of such a system having at least two and preferably at least three double splayed guidelines.

Yet another object of the present invention is the provision of a system having at least two and preferably at least three splayed guidelines and including means for constantly tensioning the splayed guidelines.

And another object of the present invention is the provision of a system having at least two and preferably at least three splayed guidelines and a means for individually controlling the tension in each of the splayed guidelines.

Another object of the present invention is the provision of a system for monitoring and controlling the position of the equipment as it is lowered.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
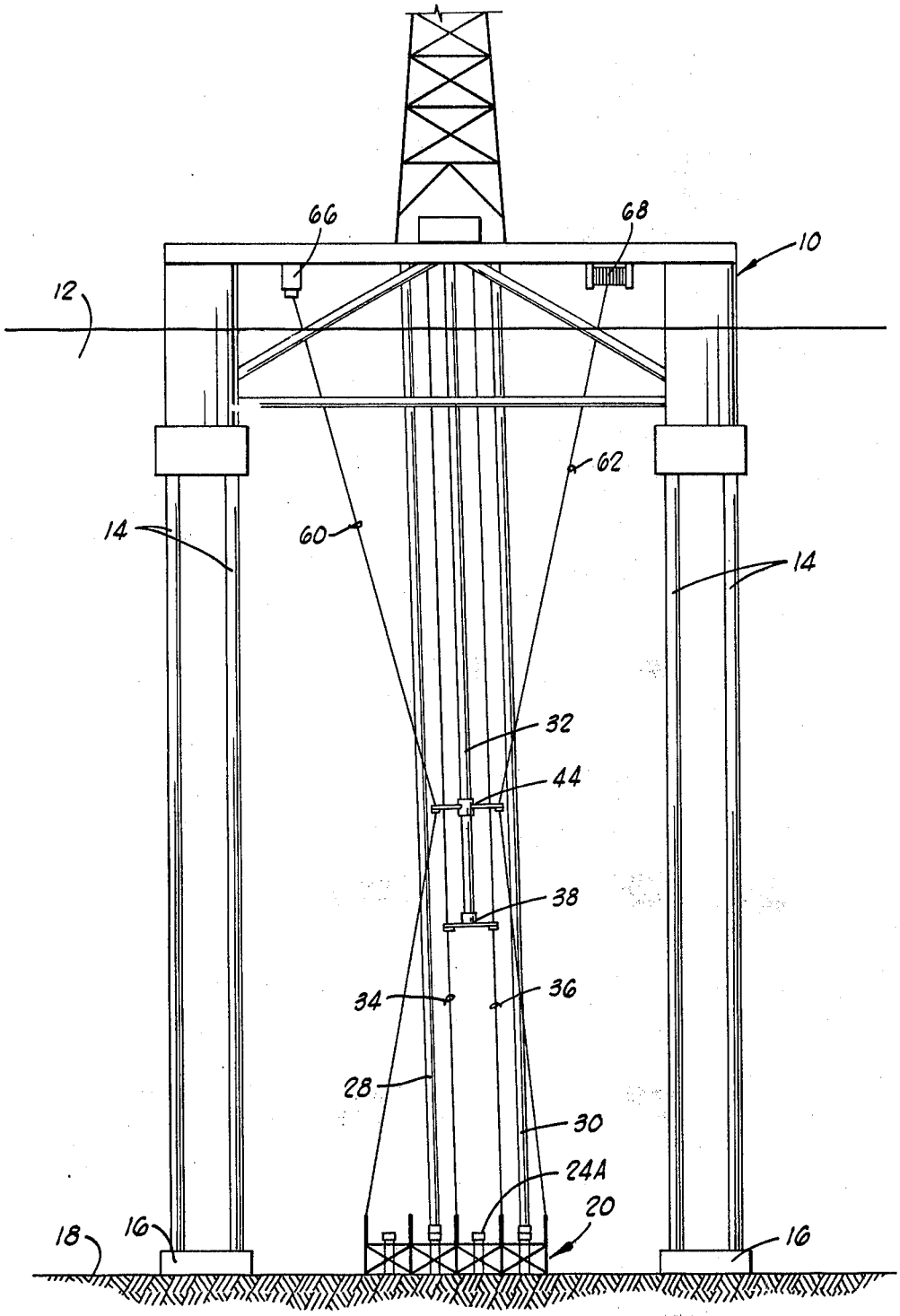
FIG. 1 is a schematic elevation view of a tension leg platform located above a subsea wellhead template, with two risers already connected between the tension leg platform and the subsea wellhead template, and with a third adjacent riser being lowered into place with the aid of a splayed guideline system.

Referring now to the drawings, and particularly to FIG. 1, a tension leg platform 10 is thereshown anchored in a body of water 12 by a plurality of tethering elements 14 attached to anchor bases 16 which are anchored in place on the floor 18 of the body of water.

A subsea wellhead template 20 is located on the ocean floor 18.

Figure 4:
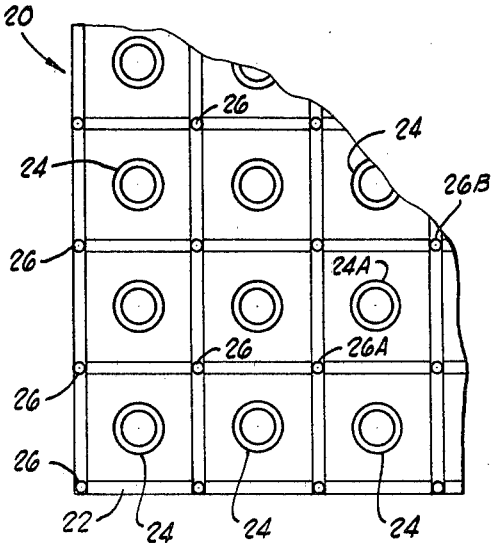
FIG. 4 is the schematic plan view of the subsea wellhead template.

FIG. 4 shows a plan view of a portion of the subsea wellhead template 20. As is thereshown, the template 20 includes a framework 22 within which is arranged a plurality of regularly spaced wellheads 24.

The framework 22 also supports a plurality of guideposts 26 which are generally arranged so that a square pattern of four guideposts 26 are provided about any one of the wellheads 24.

Referring again to FIG. 1, two risers 28 and 30 are shown already in place between the tension leg platform 10 and the subsea wellhead template 20. A third riser 32 is shown being lowered from the tension leg platform 10 to the wellhead template 20.

Two conventional constantly tensioned parallel guidelines 34 and 36 are connected between tension leg platform 10 and subsea wellhead template 20 on diagonally opposite sides of a wellhead 24A to which the riser 32 is to be connected.

For example, referring to FIG. 4, one of the wellheads thereof has been denoted as 24A for purposes of illustration, and two diagonal guideposts such as 26A and 26B would be utilized to connect the parallel guidelines 34 and 36. Parallel guidelines could be connected to all four guideposts 26 around wellhead 24A.

Figure 3:
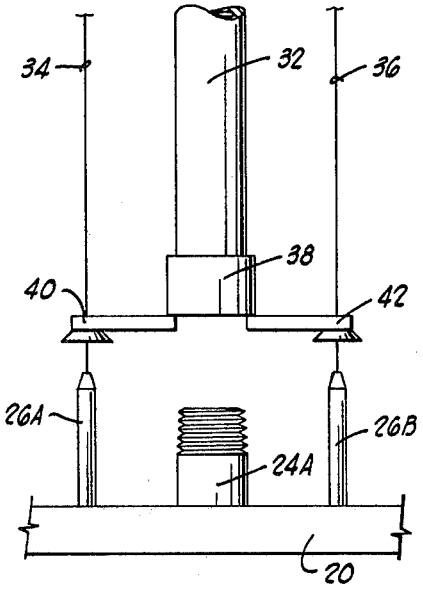
FIG. 3 is a schematic elevation view of the lower end of a production riser being lowered into engagement with a wellhead on the subsea wellhead template, wherein at least two parallel guidelines are utilized to aid in the positioning of the riser.

Referring to FIG. 3, a schematic elevation view is thereshown of the wellhead 24A, the guideposts 26A and 26B, and the parallel constantly tensioned guidelines 34 and 36. The constant tension on parallel guidelines 34 and 36 is provided in a manner analogous to that illustrated in FIG. 6 and described below.

On the lower end of riser 32 there is a conventional wellhead connector 38 and conventional follower means 40 and 42 are attached thereto and have the constantly tensioned parallel guidelines 34 and 36 slidably received therein for guiding the wellhead connector 38 into engagement with the wellhead 24A.

Figure 2:
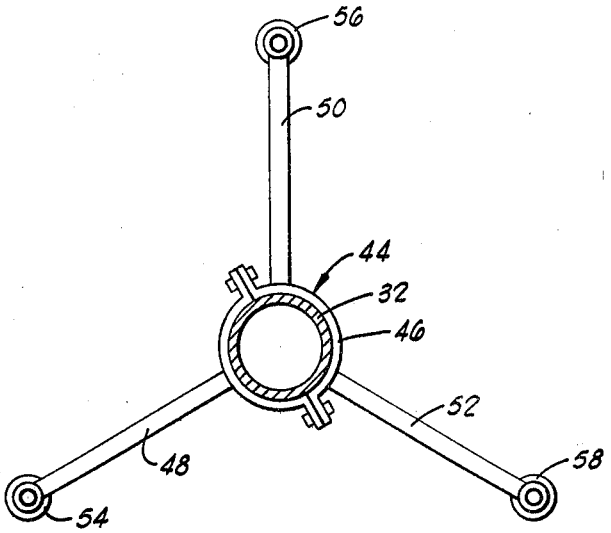
FIG. 2 is a plan view of a follower means for attachment to a production riser to allow the same to slidably receive three splayed guidelines.

Referring again to FIG. 1, a splayed guideline follower means 44 is connected to the riser 32. An enlarged plan view of splayed guideline follower means 44 is shown in FIG. 2. There it is seen that a central ring 46 is bolted about riser 32 and has three arms 48, 50 and 52 extending radially therefrom with guideline receivers 54, 56 and 58 attached to the radially outer ends thereof. The guideline receivers 54, 56 and 58 may be constructed in a manner similar to those which have been conventionally used for receiving parallel guidelines such as shown in FIG. 3.

Three splayed guidelines, two of which are shown in FIG. 1 and designated as 60 and 62, are connected between the tension leg platform 10 and the subsea wellhead template 20. Tension leg platform 10 may be referred to as a surface structure, and subsea wellhead template 20 may be referred to as a fixed structure located within the body of water 12 below the tension leg platform 10.

Figure 5:
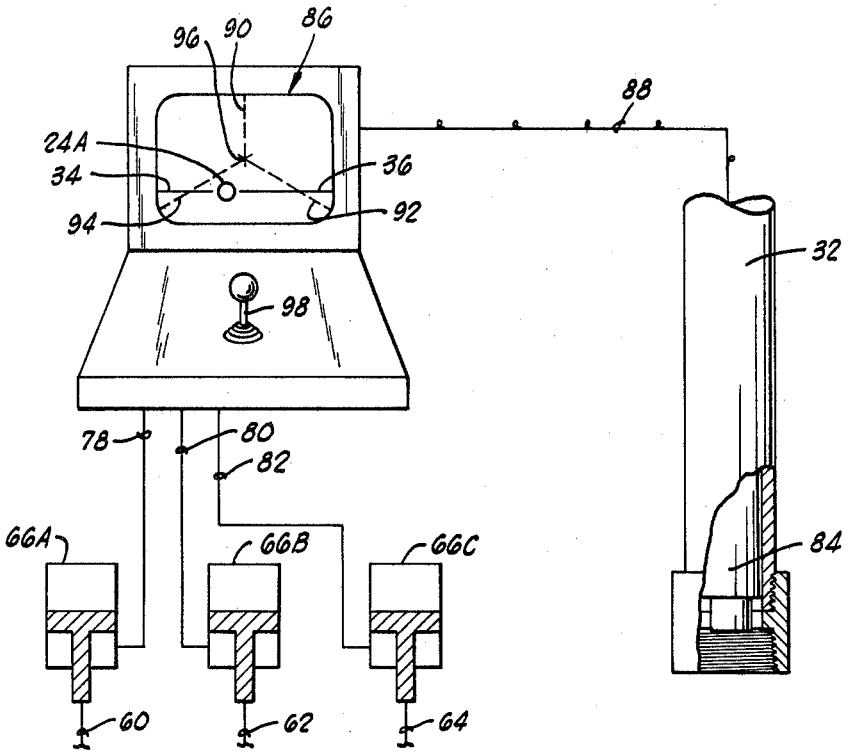
FIG. 5 is a schematic illustration of a control system utilizing video monitoring of the position of the riser as it is lowered, and utilizing a joystick operator to conrol the tension being applied to three splayed guidelines by means of hydraulic ram type tensioners.

As schematically illustrated in FIG. 5, there are actually preferably three of these splayed guidelines which are designated as 60, 62 and 64. The third splayed gudieline 64 is not visible in FIG. 1 since it is located behind the other equipment which is there illustrated. Also, it is noted that FIG. 1 is a schematic illustration and only two of the splayed guidelines are there shown for ease of illustration.

Each of the splayed guidelines 60, 62 and 64 is slidably received within one of the guideline receivers 54, 56 and 58 and is arranged as seen in FIG. 1 so that the guidelines are outwardly splayed away from each other both above and below the follower means 44 attached to the riser 32.

The exact portion of the guidelines 60, 62 and 64 touching the follower means 44 is generally referred to as a point of sliding engagement of the guidelines 60, 62 and 64 with the riser 32.

The upper ends of the splayed guidelines are attached to a tension means for tensioning the splayed guidelines to exert a lateral force on the riser 32 as it is being lowered.

The tension means may include various types of guideline tensioners, two of which are schematically illustrated in FIG. 1. A hydraulic ram type tensioner 66 is shown connected to the upper end of splayed guideline 60. A rotary winch type tensioner 68 is shown connected to the upper end of splayed guideline 62. It will be understood that generally the same type of tensioner will be utilized for all three of the splayed guidelines, but alternative versions are shown in FIG. 1 merely to prevent unnecessary duplication of drawings.

The hydraulic ram type tensioner 66 may for example be obtained from the NL Shaffer company or the Vetco company in the form illustrated at pages 4950–4954 and pages 6861–6862, respectively, of the 1978–79 COMPOSITE CATALOG OF OIL FIELD EQUIPMENT & SERVICES.

Depending upon the particular application involved, the splayed guidelines 60, 62 and 64 may be tensioned either by a system providing a constant equal tension in each of the splayed guidelines, or by a system providing separately variable tension in each of the guidelines.

Figure 6:
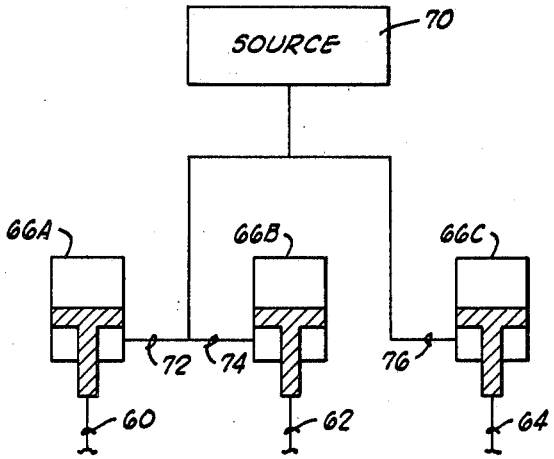
FIG. 6 is a schematic illustration of a system providing equal constant tension to the three splayed guidelines.

FIG. 6 schematically illustrates a system having three hydraulic ram type tensioners 66A, 66B and 66C which have the piston members thereof attached to the splayed guidelines 60, 62 and 64. A common hydraulic power source 70 is connected by hydraulically parallel fluid supply lines 72, 74, and 76 to the hydraulic ram tensioners 66A, B and C, so that equal constant tension forces are applied to the splayed guidelines 60, 62 and 64.

A system providing separately variable guideline tensioners to each of the splayed guidelines 60, 62 and 64 is schematically illustrated in FIG. 5. There the three hydraulic ram tensioners 66A, 66B and 66C each have separate independent fluid supply lines such as 78, 80 and 82.

The tension means illustrated in FIG. 5 includes first, second and third separately variable guideline tensioners 66A, 66B and 66C, respectively, one of which is attached to each of the splayed guidelines 60, 62 and 64 for separately varying a tension in each of said splayed guidelines.

In connection with the separately variable tension means of FIG. 5, it is desirable to provide a position indicator means for providing an indication at a surface of the body of water 12 of the position of the riser 32 as it is lowered in relation to adjacent previously positioned subsea equipment such as first and second risers 28 and 30. Such a position indicator means is illustrated schematically in FIG. 5, and includes a TV camera 84 mounted in the lower end of riser 32 and pointed downward so as to view directly below the riser 32. TV camera 84 is connected to a video display screen 86 located in a control room on the tension leg platform 10. This connection is provided by electrical connecting means 88.

Schematically illustrated as displayed on the screen 86 is an image of the upper end of wellhead 24A and of the parallel guidelines 34 and 36 on diagonally opposite sides thereof. It will be understood that as the riser 32 moves laterally relative to the wellhead 24A, the position of the image of wellhead 24A and parallel guidelines 34 and 36 on the screen 86 will move on the screen 86.

The screen 86 has three fixed target lines 90, 92 and 94 superimposed thereon which intersect at center point 96 representing the desired location of the image of wellhead 24A.

The target lines 90, 92 and 94 are arranged at angles of 120° therebetween to represent the orientation of the three splayed guidelines 60, 62 and 64 which are themselves arranged preferably at angles of 120° about the periphery of riser 32. The target lines 90, 92 and 94 may be thought of as corresponding to guidelines 60, 62 and 64, respectively.

Also, it will be readily apparent that all the adjacent structures such as subsea wellhead template 20 and the risers 28 and 30 will be visible on the screen 86, although they have not been shown in FIG. 5.

A control means 98 is provided for controlling the tension in each of the splayed guidelines 60, 62 and 64. In the system illustrated in FIG. 5, the control means 98 includes a joystick operator handle, the position of which, in conjunction with a suitable fluid power source and supply valve control system (not shown), determines simultaneously the separately variable hydraulic pressures being directed to each of the hydraulic ram tensioners 66A, 66B and 66C.

The center point 96 represents the position of the camera 84, and thus of the lower end of riser 32, and thus a human operator working the joystick operator handle 98 will observe the position of the riser relative to surrounding equipment and control the position of riser 32 by moving the joystick operator handle 98 so that the image of wellhead 24A coincides with center point 96.

Similarly, the television cameras such as 84 could be mounted adjacent the riser 32 by a framework such as illustrated in U.S. Pat. No. 3,215,202 to Pollard et al. so that the screen 86 will directly display the image of the lower end of riser 32 and the adjacent surroundings so that the actual engagement of riser 32 with wellhead 24A could be viewed.

A combination of both types of position indicator systems could be utilized such that one video display screen displays a view such as that illustrated in FIG. 5, and a second screen illustrates a view such as would be provided by a system like that of U.S. Pat. No. 3,215,202 to Pollard et al.

Also, it is possible to use acoustic position indicator systems instead of the video system illustrated in FIG. 5.

The system just illustrated and described, utilizes three double splayed guidelines located at angles of 120° about the riser 32.

The preferred embodiment of the invention illustrated in the drawing and just described above has three splayed guidelines. It is necessary to have at least three splayed guidelines to provide complete control of lateral movement of riser 32 in any horizontal direction. It is of course possible to utilize more than three splayed guidelines. There are, however, situations where only two splayed guidelines may be necessary to achieve the desired positioning. Those would be situations wherein control in only one general horizontal direction was needed. For example, only two splayed guidelines would be required if the current were constantly from only one direction and/or if adjacent risers were only on diametrically opposite sides of a subsea location to which a third riser being lowered is to be connected.

Also, the splayed guidelines 60, 62 and 64 are illustrated as being splayed both above and below the point of sliding engagement with the follower means 44, and thus they have been referred to as double splayed guidelines. It is possible to achieve the advantages of the present invention to a somewhat lesser degree by utilizing single splayed guidelines, i.e., an arrangement of guidelines wherein the guidelines were outwardly splayed only in one direction either above or below the follower means 44.

The principle behind the use of splayed guidelines, as opposed to using parallel guidelines for guiding subsea equipment into place as it is lowered within a body of water, is that greater lateral forces can be applied by the use of splayed guidelines for a given tension present in the guideline. This is a matter of the geometric arrangement of the guidelines. Thus, the actual tension in the splayed guidelines can be reduced as compared to a system which uses only parallel guidelines.

It is entirely possible in prior art type systems using parallel guidelines, if you are lowering very heavy equipment in hostile environments wherein severe lateral hydrodynamic forces are encountered, that the tension forces which would be necessary to provide sufficient lateral force to control the lateral position of the equipment being lowered would be very much greater than the breaking strength of conventional wire cable guidelines. Thus, guidelines of much greater size than normal, requiring much larger tensioning means would be required.

Alternatively, if using only parallel guidelines it could become necessary to spread out the locations of the wellheads to allow more tolerance in the lateral position control required.

Preferably in optimizing the concept of the present invention for any particular application, the angle at which the splayed guidelines are splayed will be arranged such that wire cable guidelines of conventional sizes, in a range of about $\frac{5}{8}$ to $\frac{3}{4}$ inch diameter, can be utilized with only a single conventional hydraulic ram type tensioner provided on each splayed guideline to provide sufficient lateral forces for the necessary lateral positioning control.

Thus it is seen that the apparatus and methods of the present invention readily achieve the ends and advantages mentioned as well as those inherent therein. While certain preferred embodiments of the present invention have been illustrated for the purposes of the present disclosure, numerous changes in the arrangement and construction of parts and steps may be made by those skilled in the art, which changes are encompassed within the scope and spirit of this invention as defined by the appended claims.

What is claimed is:

1. A method of laterally positioning a second item of subsea equipment adjacent an existing first item of subsea equipment while lowering said second item from a surface structure toward a floor of a body of water, said method comprising:

providing at least two guidelines between said surface structure and a fixed structure located within said body of water below said surface structure;

slidably connecting said second item to said guidelines so that said guidlines are outwardly splayed in at least one direction above or below a point of sliding engagement of said guidelines with said second item;

lowering said second item from said surface structure so that said second item slides downward along said splayed guidelines; and tensioning said splayed guidelines against the surface structure and the fixed structure to exert a lateral force on said second item.

2. The method of claim 1, wherein:

said tensioning step is further characterized as separately controlling a tension in each of said splayed guidelines.

3. The method of claim 2, further comprising:

observing a position of said second item relative to said first item; and controlling said tension in each of said splayed guidelines so as to move said second item laterally to a desired position relative to said first item.

4. The method of claim 1, further comprising:

providing at least two parallel guidelines between said surface structure and said fixed structure; and slidably connecting said second item to said parallel guidelines so that said parallel guidelines remain parallel.

5. The method of claim 4, further comprising:

providing a constant tension force to said parallel guidelines.

6. The method of claim 1, further comprising:

providing a constant tension force on said splayed guidelines.

7. The method of claim 1, wherein:

said step of slidably connecting is further characterized as slidably connecting said second item to said guidelines so that said guidelines are outwardly splayed both above and below said point of sliding engagement of said guidelines with said second item.

8. The method of claim 1, wherein:

said providing step is further characterized as providing at least three splayed guidelines between said surface structure and said fixed structure.

9. A system for laterally positioning subsea equipment while lowering said subsea equipment from a surface structure toward a floor of a body of water, comprising:

follower means, attached to said subsea equipment;

at least two guidelines connected between said surface structure and a fixed structure located within said body of water below said surface structure, said guidelines being slidably received by said follower means and arranged so that said guidelines are outwardly splayed in at least one direction above or below said follower means; and tension means for tensioning said splayed guidelines against the surface structure and the fixed structure to exert a lateral force on said subsea equipment.

10. The system of claim 9, further comprising:

at least a third splayed guideline connected between said surface structure and said fixed structure and slidably received by said follower means.

11. The system of claim 10, wherein:

said tension means includes first, second and third separately variable guideline tensioners, one attached to each of said splayed guidelines, for separately varying a tension in each of said splayed guidelines.

12. The system of claim 11, further comprising:

at least two parallel guidelines connected between said surface structure and said fixed structure and slidably received by a second follower means connected to said subsea equipment.

13. The system of claim 12, wherein:

said parallel guidelines are constant tension guidelines.

14. The system of claim 11, wherein:

each of said first, second and third guideline tensioners includes a hydraulic ram tensioning element.

15. The system of claim 14, wherein:

each of said first, second and third guideline tensioners includes one and only one hydraulic ram tensioning element.

16. The system of claim 11, wherein:

each of said first, second and third guideline tensioners includes a rotary winch.

17. The system of claim 11, further comprising:

position indicator means, operably associated with said subsea equipment, for providing an indication at a surface of said body of water of a position of said subsea equipment being lowered in relation to adjacent previously positioned subsea equipment.

18. The system of claim 11, further comprising:

control means, operably associated with said first, second and third guideline tensioners, for controlling the tension in each of said splayed guidelines to thereby control a lateral position of said subsea equipment as said subsea equipment is lowered into said body of water.

19. The system of claim 18, wherein:

said control means includes a joystick operator handle means, operably associated with each of said first, second and third guideline tensioners, for simultaneously controlling the tension in each of said splayed guidelines.

20. The system of claim 19, further comprising:

position indicator means, operably associated with said subsea equipment, for providing an indication at a location adjacent said joystick operator handle means of a position of said subsea equipment being lowered in relation to adjacent previously positioned subsea equipment.

21. The system of claim 10, wherein:

said tension means is further characterized as a means for providing a constant tension in each of said splayed guidelines.

22. The system of claim 10, wherein:

said three guidelines are further characterized as being arranged so that said guidelines are outwardly splayed both above and below said follower means.

23. A system for positioning multiple risers between a tension leg platform and a subsea wellhead template, comprising:

at least two constantly tensioned parallel guidelines connected between said tension leg platform and said subsea wellhead template for each of said risers to be positioned; and at least three splayed guidelines connected between said tension leg platform and said subsea wellhead template, said splayed guidelines being slidably received in a follower means of each of said risers as each of said risers is lowered from said tension leg platform to said subsea wellhead template.

24. The system of claim 23, further comprising:

means for constantly tensioning said three splayed guidelines.

25. The system of claim 23, further comprising:

means for varying and controlling a tension in each of said splayed guidelines separately.

26. The system of claim 23, wherein:

each of said splayed guidelines is further characterized as being double splayed.

* * * * *